United States Patent [19]

Mayer

[11] Patent Number: 4,798,049

[45] Date of Patent: Jan. 17, 1989

[54] INTERNAL COMBUSTION ENGINE WITH PRESSURE-WAVE SUPERCHARGER AND LAMBDA PROBE

[75] Inventor: Andreas Mayer, Niederrohrdorf, Switzerland

[73] Assignee: BBC Brown Boveri AG, Baden, Switzerland

[21] Appl. No.: 69,485

[22] Filed: Jul. 2, 1987

[30] Foreign Application Priority Data

Jul. 8, 1986 [CH] Switzerland ..... 2749/86

[51] Int. Cl.[4] ..... F01N 3/02

[52] U.S. Cl. ..... 60/276; 60/285; 123/559.2

[58] Field of Search ..... 60/274, 276, 285; 123/559.2

[56] References Cited

U.S. PATENT DOCUMENTS 4,553,387 11/1985 Mayer ..... 60/285
4,615,172 10/1986 Mayer ..... 123/559 A
4,702,075 10/1987 Jenny ..... 60/274

FOREIGN PATENT DOCUMENTS 0152870 8/1985 European Pat. Off. .
2354313 5/1974 Fed. Rep. of Germany .
3526532 2/1986 Fed. Rep. of Germany .

*Primary Examiner*—Douglas Hart
*Attorney, Agent, or Firm*—Burns, Doane, Swecker & Mathis

[57] ABSTRACT

In an internal combustion engine supercharged by a pressure-wave supercharger (2), a lambda probe (7) is used for measurement of the oxygen content in the circuit. The oxygen content determined by the lambda probe (7) creates a measuring signal (9), which is used for controlling the throttle valve (4) and/or the starting valve (6). This control is aimed at reducing the $NO_x$ emissions from the combustion and possibly ensuring the regeneration of an exhaust gas particle filter (3) integrated in the circuit. In this arrangement, the lambda probe (7) is to be placed in the low-pressure exhaust gas line (444), which has a positive effect on the response capability and the accuracy of the measured data of the probe (7). This obviates the need for additional aids for the correction of pressure fluctuations such as occur at other points in the circuit of the internal combustion engine.

6 Claims, 2 Drawing Sheets

INTERNAL COMBUSTION ENGINE WITH PRESSURE-WAVE SUPERCHARGER AND LAMBDA PROBE

FIELD OF THE INVENTION

The present invention relates to the circuit of an internal combustion engine supercharged by a pressure-wave supercharger.

BACKGROUND OF THE INVENTION

To improve the emission behavior of internal combustion engines, provisions are increasingly being made for fitting exhaust gas particle filters. The primary object of these filters is to capture the soot particles harmful to the environment. Latest proposals suggest catalytically coating the filtering channels of these exhaust gas particle filters, making it possible to neutralize further pollutants from the combustion. It is obvious that the soot particles captured will, in time, inevitably clog the filter: the flow resistance of the exhaust gas stream then increases extremely, which adversely affects the efficiency of the internal combustion engine. Countermeasures are aimed at eliminating the soot coating by combustion, through increasing the filter temperature permanently or for a short time.

However, in order that this combustion can take place at all, it must be ensured that the exhaust gases bring in sufficient oxygen during the combustion of the soot coating on the filter.

Therefore, in principle it is a question of on the one hand recirculating exhaust gas into the combustion air of the engine, to increase the exhaust gas temperature and thus the filter temperature for the purpose of regenerating the exhaust gas particle filter, and on the other hand of ensuring the minimum necessary or the optimum desired oxygen supply.

To regulate the oxygen content in regeneration of the exhaust gas particle filter, and consequently to control the throttle valve, a "lambda probe" is fitted between engine and exhaust gas particle filter as an oxygen sensor, the measuring signal of which is fed to a control system of the internal combustion engine, which acts in a suitable way on the fresh air supply and/or the quantity of fuel.

A "lambda probe", with a $ZRO_2$ ceramic, suitable for measurement of the oxygen content in the exhaust of internal combustion engines relative to the oxygen content of the air has become known for example from the article by Hans-Martin Wiedenmann et al. "Heated Zirconia Oxygen Sensor for Stoichiometric and Lean Air-Fuel Ratios", SAE-Paper 840141, SAE-Congress, Detroit, February-March 1984.

In principle, it may be stated that the oxygen partial pressure in the exhaust gas varies however with the exhaust gas pressure. Now the pressure of the exhaust gas in the exhaust system of an internal combustion engine is by no means constant, but depends strongly on the degree of clogging of the exhaust gas particle filter and on the engine speed. In the case of supercharged internal combustion engines, the pressure fluctuations in the exhaust system are much greater, as the supercharging ratio concerned is also added to the said effects of engine speed and degree of clogging of the exhaust gas particle filter.

As far as a circuit of a supercharged internal combustion engine is concerned, this means that if the lambda probe is fitted in the high-pressure exhaust gas stream, the pressure prevailing there proves to be an inadmissible disturbance, because the: output signal of the lambda probe is pressure-dependent: all in all, the pressure of the exhaust gas in the exhaust system may fluctuate by a multiple of the air pressure. It goes without saying that, under such conditions, measurement of the percentage content of oxygen in the exhaust by means of the known lambda probe screwed directly into a wall of the exhaust system does not provide any useful results. If a remedy to this is sought, this requires a pressure correction or fitting of the lambda probe in a bypass part-stream of the exhaust system, the latter remedy preferably upstream of the exhaust gas particle filter if the circuit is provided with one.

However, pressure correction, which could eliminate the effect of the exhaust gas pressure on the measuring signal of the lambda probe, is conditional on using a pressure sensor and an electronic computer unit. But this is an elaborate solution, as the pressure sensor in the exhaust system has to be extremely corrosion-resistant.

The other precaution as well, namely fitting the lambda probe in a bypass part-stream in the exhaust system, proves to be an elaborate solution, both in terms of fitting the aid in a suitable place in the circuit and also in terms of the means used.

OBJECTS AND SUMMARY OF THE INVENTION

The invention achieves the object of providing for direct fitting of the lambda probe in a place in the circuit where the oxygen content to be measured is directly true.

The advantages of the placement according to the invention of the lambda probe are essentially to be seen in that a faster response time of the lambda probe is achieved in the full stream of the low-pressure exhaust gases, because there a greater quantity flows than in a bypass part-stream. If measurements are taken in the full stream of the low-pressure exhaust gases, it is also possible to dispense with a pressure correction, because there are no pressure fluctuations there.

BRIEF DESCRIPTION OF THE DRAWINGS

An illustrative embodiment of the invention will be explained below with reference to the drawing. All elements not necessary for a direct understanding of the invention have been omitted.

DETAILED DESCRIPTION OF A PREFERRED EMBODIMENT

Figure 1:
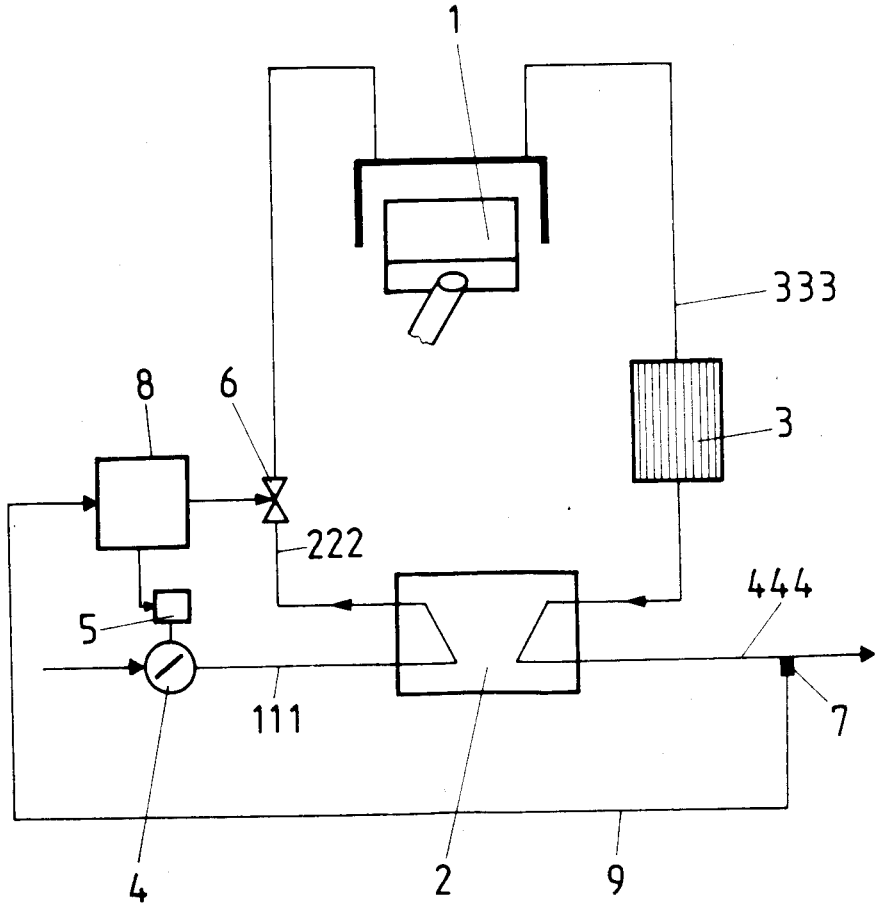
FIG. 1 is a schematic view of the circuit of an internal combustion engine supercharged with a pressure-wave supercharger and with built-in lambda probe
Figure 2:
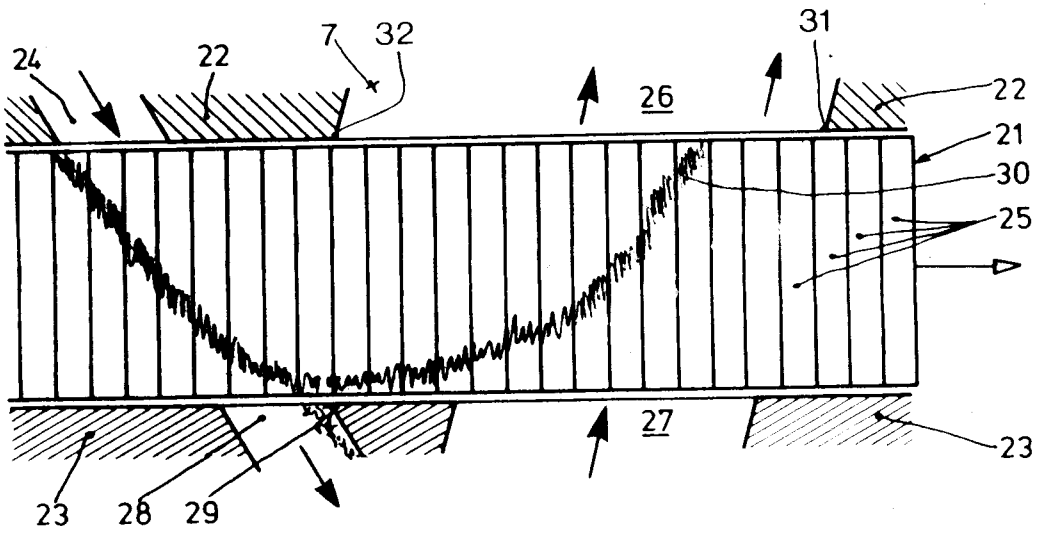
FIG. 2 is a schematic view of the arrangement of the lambda probe in the pressure-wave supercharger.

The circuit shown in FIG. 1 comprises an engine 1, a pressure-wave supercharger 2, and an exhaust gas particle filter 3. Placed in the air intake line 111 to the pressure-wave supercharger is a throttle valve 4, which is adjusted by a motor operator 5. Placed in the line for the fresh air supply 222 to the engine 1 is a starting valve or an automatic charge air valve system 6. The exhaust gas particle filter 3 is fitted in the high-pressure exhaust gas line 333, in other words between engine 1 and pressure-wave supercharger 2. In the low-pressure exhaust gas line 444 there operates a lambda probe 7, the arrangement of which is kept separate from a possible scavenging stream, preferably in the opening region of the low-pressure gas discharge duct 26 (FIG. 2). The lambda probe 7 determines the oxygen content in the exhaust, once the latter has performed supercharging work in the pressure-wave supercharger 2. Measurement of the oxygen content therefore takes place under constant pressure conditions. In the case of an internal combustion engine supercharged with a pressure-wave supercharger 2, a person skilled in the art would not measure the oxygen concentration in the low-pressure exhaust 444, because this is mixed with scavenging air and the λ measured does not coincide with the actual excess air count in the high-pressure exhaust 333. The lambda probe 7 in the full stream of the low-pressure exhaust 444 consequently only operates correctly if the degree of scavenging of the pressure-wave supercharger 2 is $\eta$ sp≦0 or if the exhaust gas recirculation is Rz<0. Now, in the normal operating range of a pressure-wave supercharger 2, it is possible to fit the lambda probe 7 in the full stream of the low-pressure exhaust 444 despite the scavenging function in the low-pressure zone, since $\eta$ sp is always less than zero, or recirculation is always greater than zero, in the control range of the throttle valve 4. The surprising possibility that the lambda probe 7 can be placed in the full stream of the low-pressure exhaust 444 in a circuit of an internal combustion engine supercharged by a pressure-wave supercharger 2 is thus conditional on the exhaust not being mixed with the additional scavenging air, i.e. that the oxygen concentration of the engine exhaust is not falsified. As already stated, this is always the case within the control range of the throttle valve 4. The oxygen content measured by the lambda probe 7 in the full stream of the low-pressure exhaust 444, produced for example by diffusion of the oxygen through a solid-state electrolyte, creates a measuring signal 9 for the computer unit 8: the corresponding control information then acts on the throttle valve 4 and/or the starting valve 6. If a circuit does not have any filtering of the exhaust gases, the lambda probe 7 is used to reduce the $NO_X$ values. The use of a poorly heat-conducting material for connection of the lambda probe 7 to the exhaust system can be used additionally to particular advantage for reducing the effects of the temperature fluctuations of the exhaust on the measuring signal 9 of the lambda probe 7.

This is of quite considerable significance in particular in the case of internal combustion engines which are operated with a high oxygen content in the exhaust, in particular in the case of diesel engines.

FIG. 2 shows an advantageous fitting variant within gas-dynamic pressure-wave machines.

The basic design of such a pressure-wave machine, and its precise structure, can be taken from the applicant's publication CH-T No. 123 143 or from Swiss Patent No. 378 595. FIG. 2 shows it as the development of a cylindrical section half way up the cells through the rotor and through the adjoining portions of the side parts of the housing. For the sake of simplicity, it is represented as a single-cycle machine, which is manifested by the fact that the gas housing 22 and the air housing 23 are provided with only one high-pressure opening and one low pressure opening on their sides facing the rotor 21. To explain the function of the system more clearly, the directions of flow of the working media and the direction of rotation of the pressure-wave machine are denoted by arrows.

The hot exhaust gases of the combustion engine not shown here pass through the high-pressure gas inflow duct 24 into the rotor 21, provided with axially straight cells 25 open on both sides, expand therein and leave it via the low-pressure gas outflow duct 26 to the exhaust pipe (not shown). On the air side, the atmospheric fresh air is sucked in, flows via the low-pressure air intake duct 27 axially into the rotor 21, is compressed therein and leaves it as charge air via the high-pressure air outlet duct 28 to the engine via a charge air cooler (not shown).

For an understanding of the actual, extremely complex, gas-dynamic pressure-wave process, which is not a subject of the invention, you are referred to the publication already mentioned, CH-T No. 123 143. The process sequence necessary for an understanding of the invention is briefly explained below: The band of cells comprising the cells 25 is the development of a cylindrical section of the rotor 21 which moves to the right when the latter is rotated in the direction of the arrow. The pressure-wave processes take place inside the rotor 21 and essentially have the effect that a gas-filled space and an air-filled space form. In the first of these, the exhaust gas expands and then escapes into the low-pressure gas outflow duct 26, while in the second of these part of the fresh air sucked in is compressed and pushed out into the high-pressure air outlet duct 28. The remaining proportion of fresh air is flushed over into the low-pressure gas outflow duct 26 by the rotor and thus effects complete discharge of the exhaust gases. This scavenging is essential for the process sequence and has to be maintained under all circumstances. It must be avoided in any event that exhaust gas remains in the rotor 21 and is supplied to the engine with the charge air during a subsequent cycle.

Depending on the machine layout and operating conditions, a recirculation of a certain quantity of exhaust takes place; for reasons of environmental protection, this is even desirable. This is achieved by the fact that a certain proportion of gas passes over onto the air side and is flushed over into the high-pressure outlet duct 28 in the region of the closing edge 29. This situation is represented in the basic diagram by the separating front 30 between air and gas. This separating front is not a sharp delimitation, but rather a relatively broad mixing zone. The charge air thus loaded with exhaust gas brings about the desired increase in the exhaust gas temperature.

As already mentioned in the description of FIG. 1, the proportion of scavenging air falsifies the measurement, depending on the position of the lambda probe, to the extent that a value greater than the true λ would be measured. This would be the case for example if the probe were in the region of the closing edge 31 of the low-pressure gas outflow duct 26. Therefore, the lambda probe 7 is arranged to advantage in the region of the opening edge 32 of the low-pressure gas outflow duct 26, in other words in a position where there is a pure exhaust gas flow under all conditions.

While this invention has been illustrated and described in accordance with a preferred embodiment, it is recognized that variations and changes may be made and equivalents employed herein without departing from the invention as set forth in the claims.

What is claimed is:

1. A circuit of an internal combustion engine supercharged by a pressure-wave supercharger, comprising an engine, a pressure-wave supercharger having a low-pressure exhaust gas line, and exhaust gas particle filter, a throttle valve and a starting valve, wherein a Lambda probe is fitted in the low-pressure exhaust gas line, the measuring signal of which probe acts via a computer unit on the throttle valve.

2. The circuit according to claim 1, wherein the Lambda probe measures the exhaust gases flowing through the low-pressure exhaust gas line in the full stream.

3. The circuit according to claim 2, wherein the Lambda probe is arranged in an opening region of a low-pressure gas outflow duct.

4. A circuit of an internal combustion engine supercharged by a pressure-wave supercharger, comprising an engine, a pressure-wave supercharger having a low-pressure exhaust line, an exhaust gas particle filter, a throttle valve, and a starting valve, wherein a Lambda probe is fitted in the low-pressure exhaust gas line, the measuring signal of which probe acts via a computer unit on the starting valve.

5. The circuit according to claim 4, wherein the Lambda probe measures the exhaust gases flowing through the low-pressure exhaust gas line in the full stream.

6. The circuit according to claim 5, wherein the Lambda probe is arranged in an opening region of a low-pressure gas outflow duct.

* * * * *